US005408783A

United States Patent [19]

Sprafke et al.

[11] Patent Number: 5,408,783

[45] Date of Patent: Apr. 25, 1995

[54] DEVICE FOR OPENING AND CLOSING A HATCH ON A COMBAT VEHICLE, ESPECIALLY A MILITARY TANK

[75] Inventors: Uwe Sprafke, Schauenburg-Elmshagen; Michael Fehr, Wabern-Udenborn; Manfred Matheis, Fuldabrück, all of Germany

[73] Assignee: Firma Wegmann & Co. GmbH, Kassel, Germany

[21] Appl. No.: 149,853

[22] Filed: Nov. 10, 1993

[30] Foreign Application Priority Data

Nov. 28, 1992 [DE] Germany ..... 42 40 140.2

[51] Int. Cl.[6] ..... F41H 5/22; E05F 11/02

[52] U.S. Cl. ..... 49/279; 49/210; 49/362; 89/36.08; 109/69

[58] Field of Search ..... 49/279, 62, 65, 362, 49/210; 89/36.08; 109/68, 69; 114/117

[56] References Cited

U.S. PATENT DOCUMENTS 4,587,880 5/1986 Sprafke ..... 89/36.08 X 5,105,714 4/1992 Sprafke et al. ..... 109/68 X

*Primary Examiner*—Philip C. Kannan

*Attorney, Agent, or Firm*—Sprung Horn Kramer & Woods

[57] ABSTRACT

A device for opening and closing a hatchway on a combat vehicle, especially a tank, by a hatch. The hatch comprises two components, one above the other. The upper component slides back and forth across and above the hatchway. The lower component descends tight into the hatchway. The object is to simplify the generic device to the extent that it can be operated from inside the vehicle. An operations-control rack extends along the upper component in the direction it slides back and forth in. The rack is engaged by a pinion. The pinion is part of a mechanism mounted on the vehicle and controlled from inside the vehicle. A cam track is fastened tight to the rack. A control pin rests against the cam track. The cam track operates by way of the control pin in conjunction with at least one mechanism that locks the upper component in position. The upper component is attached to the rack by a clutch. The clutch ensures that the rack will advance to a certain extent during the first stage of opening the hatchway before it engages the upper component. The control pin disengages at least one of the mechanisms that locks the upper component into position with the hatchway closed while the rack is still unengaged.

9 Claims, 4 Drawing Sheets

DEVICE FOR OPENING AND CLOSING A HATCH ON A COMBAT VEHICLE, ESPECIALLY A MILITARY TANK

BACKGROUND OF THE INVENTION

The present invention concerns a device for opening and closing a hatchway on a combat vehicle, especially a tank, by means of a hatch. The hatch comprises two components, one above the other. The upper component slides back and forth across and above the hatchway. The lower component descends tight into the hatchway. A hatch of this type is described in German Patent 3 305 882 for example.

SUMMARY OF THE INVENTION

The object of the present invention is a simple device for opening and closing the hatchway by sliding the upper component back and forth in particular from inside the vehicle. It is also possible while opening and closing the hatchway to automatically engage and disengage at least some of the mechanisms that lock the upper component into position with the hatchway open or closed. Finally, it is possible to slide the upper component back and forth and lift and lower the lower component by means of the same mechanisms.

How this object is attained in accordance with the present invention will now be described. An operations-control rack extends along the upper component in the direction in which it slides back and forth. The rack is engaged by a pinion. The pinion is part of a mechanism mounted on the vehicle and controlled from inside the vehicle. A cam track is fastened tight to the rack. A control pin rests against the cam track. The cam track operates by way of the control pin in conjunction with at least one mechanism that locks the upper component in position. The upper component is attached to the rack by a clutch. The clutch ensures that the rack will advance to a certain extent during the first stage of opening the hatchway before it engages the upper component. The control pin disengages at least one of the mechanisms that locks the upper component into position with the hatchway closed while the rack is still unengaged.

The clutch in one particularly simple version of the invention is a pin that travels back and forth in a slot between the operations-control rack and the upper component of the hatch. The slot is as long as the rack and is intended to advance while still unengaged.

The upper component in this version can be locked into position with the hatchway either open or closed by a mechanism with a control pin that rests against the cam track. The cam track can be designed to ensure that the mechanism will be unlocked while the operations-control rack is still unengaged during the first stage of opening or closing the hatchway. As will be specified hereinafter with reference to one embodiment by way of example, the upper component is unlocked, slid back and forth, and locked back into position by the controls while the hatchway is being opened in this version, whereas the preliminary lifting of the lower component is otherwise achieved.

In another embodiment of the invention that is based on the same principle of a hatch comprising an upper component that slides back and forth over, and a lower component that descends tight into, the hatchway, the lower component rests against the upper component. The upper component accommodates a mechanism that lifts and lowers the lower component. The mechanism includes a second operations-control rack. The second operations-control rack is engaged by a pinion. The pinion is attached to a transmission in the mechanism that lifts and lowers the lower component. The second rack is designed and positioned to engage the lower-component lifting-and-lowering mechanism while the first rack is still advancing unengaged. The same mechanism accordingly lifts the lower component and unlocks the upper component in this embodiment before the first stage of opening the hatchway. The upper component can be locked into position with the hatchway either open or closed by the same mechanism.

The basic concept of the invention is to make it possible to slide the upper component back and forth by means of a simple crank inside the vehicle by way of an operations-control rack fastened tight to the upper component. Specific measures ensure that the rack will be advanced unengaged before the upper component begins to slide and that whatever unlocking is necessary will occur while it is still advancing unengaged.

The device in accordance with the invention ensures that all the motions that contribute to opening the hatchway, specifically unlocking the lower hatch component, lifting it, unlocking the upper component, sliding it, and locking it into the hatchway-open position, and all the motions that contribute to closing the hatchway, specifically the same motions in the opposite sequence, can be carried out with a minimum of human intervention. The hatchway can be rapidly opened and closed. Furthermore, the whole procedure can be controlled from one point, which is of particular significance in emergencies.

Embodiments of a device in accordance with the new invention will now be specified with reference to the drawings, wherein:

DETAILED DESCRIPTION OF THE INVENTION

Figure 1:
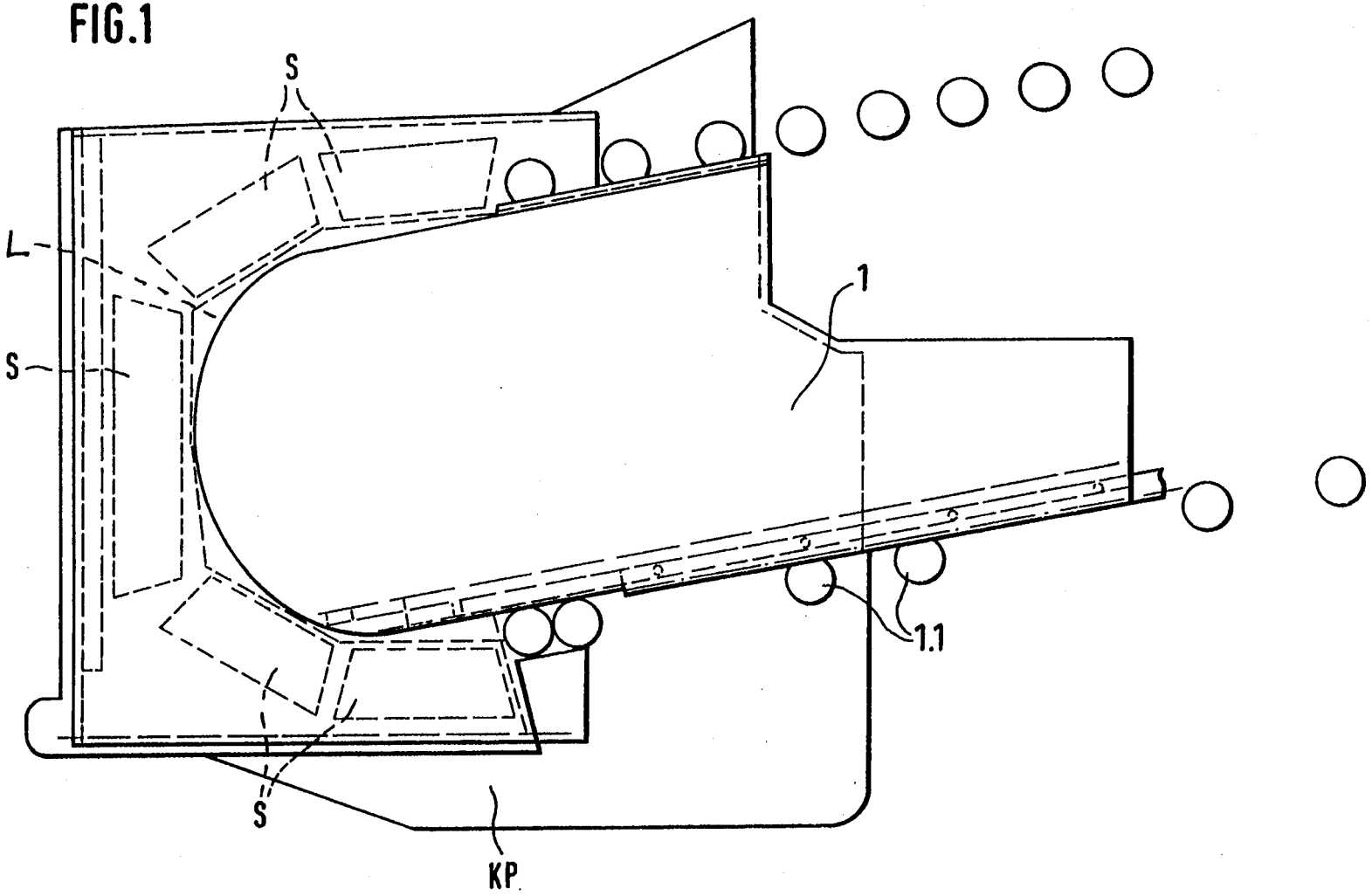
FIG. 1 is a schematic top view of a hatchway in a military tank with a hatch comprising an upper and a lower component.
Figure 2:
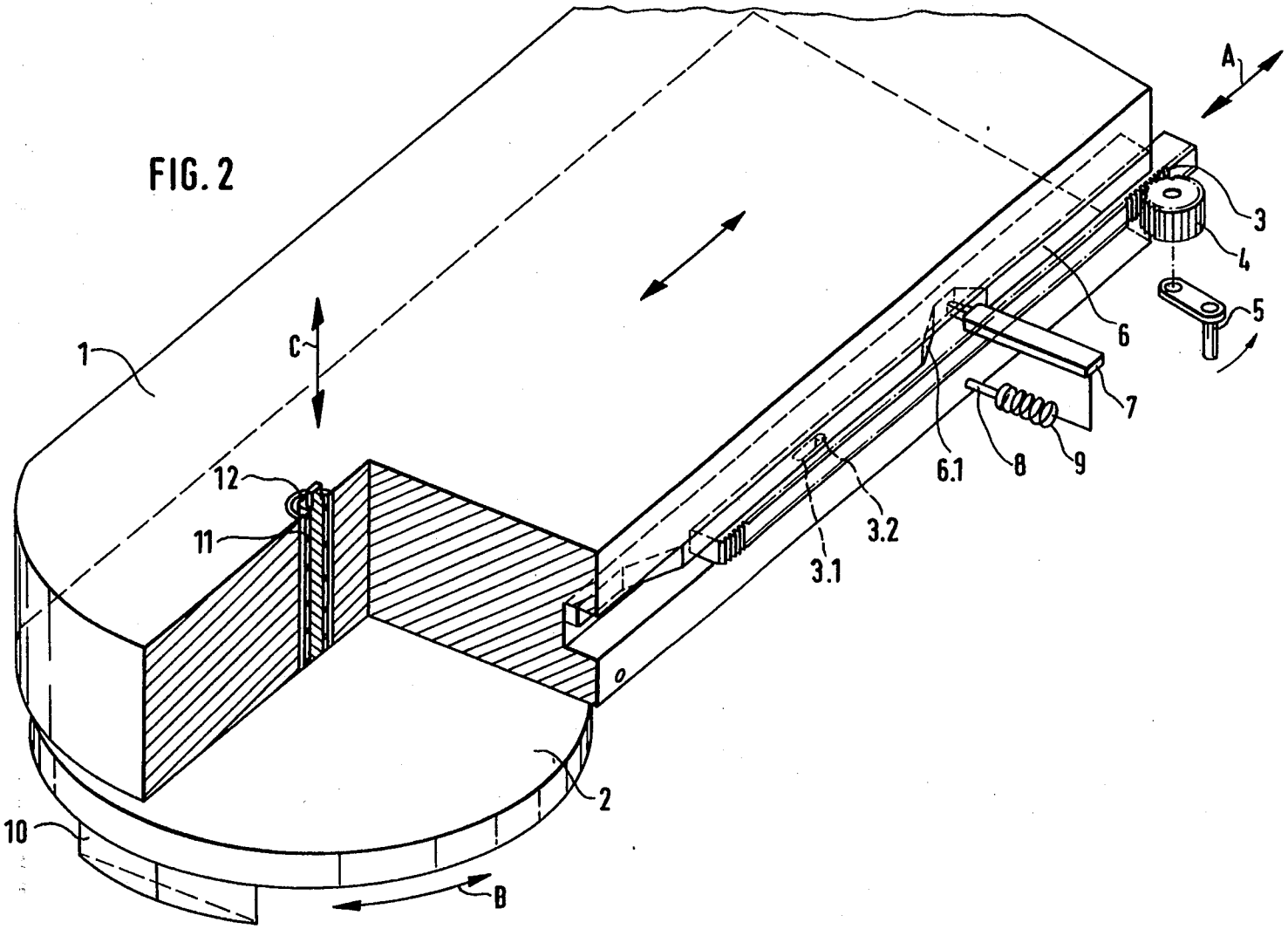
FIG. 2 is a partly broken perspective view of one embodiment of a device for sliding the upper component of the hatch illustrated in FIG. 1 back and forth into position with the hatchway either open or closed.

FIG. 1 shows the vicinity of a hatchway L in the turret of a military tank KP. Apparent in the vicinity of hatchway L is part of the vehicle's main weapon. The hatchway is surrounded by periscopes S. It is represented closed in FIG. 1. The hatchway can be opened and closed by a hatch. The hatch comprises an upper component 1, visible in FIG. 1, and, invisible in FIG. 1, a lower component 2 (FIG. 2). Upper hatch component 1 slides back and forth on roller bearings 1.1 above hatchway L and lower hatch component 2 descends into it, creating a tight seal, and rises out of it.

One embodiment of the hatchway is illustrated in greater detail in FIG. 2. The lower hatch component 2 in this embodiment is suspended from upper hatch component 1 and lifted and lowered by a spring-loaded mechanism 11. Lower hatch component 2 can be lifted in the direction indicated by double-headed arrow C by turning it with a handle 10 in the direction indicated by double-headed arrow B and locked into position there by a lower hatch-component locking mechanism 12. It then becomes possible to completely open the hatchway by sliding upper hatch component 1 back in the direction indicated by double-headed arrow A.

The motion of upper hatch component 1 is controlled by a transmission that will now be specified. A crank 5 rotates a pinion 4 that engages an operations-control rack 3. Rack 3 slides back and forth in an unillustrated track along upper hatch component 1, paralleling the direction A the component itself moves in, that is. Crank 5 can be accessed from inside the tank. Rack 3 is perforated by a slot 3.1. A pin 3.2 fastened tight to upper hatch component 1 engages slot 3.1. The ridges of the cogs are perpendicular to the plane of the hatchway opening from the outward-facing surface of operations-control rack 3. Against the bottom of operations-control rack 3 and sliding along with it is a control mechanism in the form of a cam track 6. Cam track 6 engages a mechanism that locks upper hatch component 1 into position with the hatchway either open or closed. A control pin 7 that moves in and out perpendicular to the direction that upper hatch component 1 slides in rests for this purpose against the outward-facing surface of cam track 6. Control pin 7 is attached by a connector, which can be a U-shaped strap, 7.1 to a bolt 8. A compression spring 9 forces bolt 8 perpendicular to the direction that upper hatch component 1 slides in into an unillustrated lock component that is fastened tight to the hatch component.

As crank 5 is turned and upper hatch component 1 begins to slide back and open the hatchway, operations-control rack 3 will initially, due to its connection by way of slot 3.1 and pin 3.2, remain unengaged to an extent dictated by length of slot 3.1. During this phase, control pin 7 travels along a cam 6.1 on cam track 6 that forces it out, counteracting spring 9 and disengaging bolt 8. As crank 5 continues to rotate, operations-control rack 3 engages, entraining upper hatch component 1 by way of pin 3.2. Upper hatch component 1 slides in the direction indicated by double-headed arrow A, opening the hatchway. Control pin 7 leaves cam 6.1, allowing spring 9 to lock bolt 8. Upper hatch component 1 is now locked in position with the hatchway open. Slot 3.1 and pin 3.2 will again initially maintain operations-control rack 3 unengaged as the hatchway is closed while control pin 7 travels in the opposite direction over cam 6.1. The locking mechanisms will accordingly be disengaged in this phase as well before upper hatch component 1 finally closes the hatchway.

Lower hatch component 2 can then be lowered tight by way of handle 10.

The embodiment of the device illustrated in FIG. 2 is very simple and has the advantage that one control mechanism can be very simply employed to automatically lock and unlock upper hatch component 1 in position with the hatchway either open or closed. Lower hatch component 2 must of course be lifted and lowered in a separate operation with a separate control mechanism.

Another embodiment of a device for opening and closing a hatchway will now be described. In this embodiment the lower hatch component can be lifted and lowered by way of the same control mechanism that slides the upper hatch component back and forth.

Figure 3:
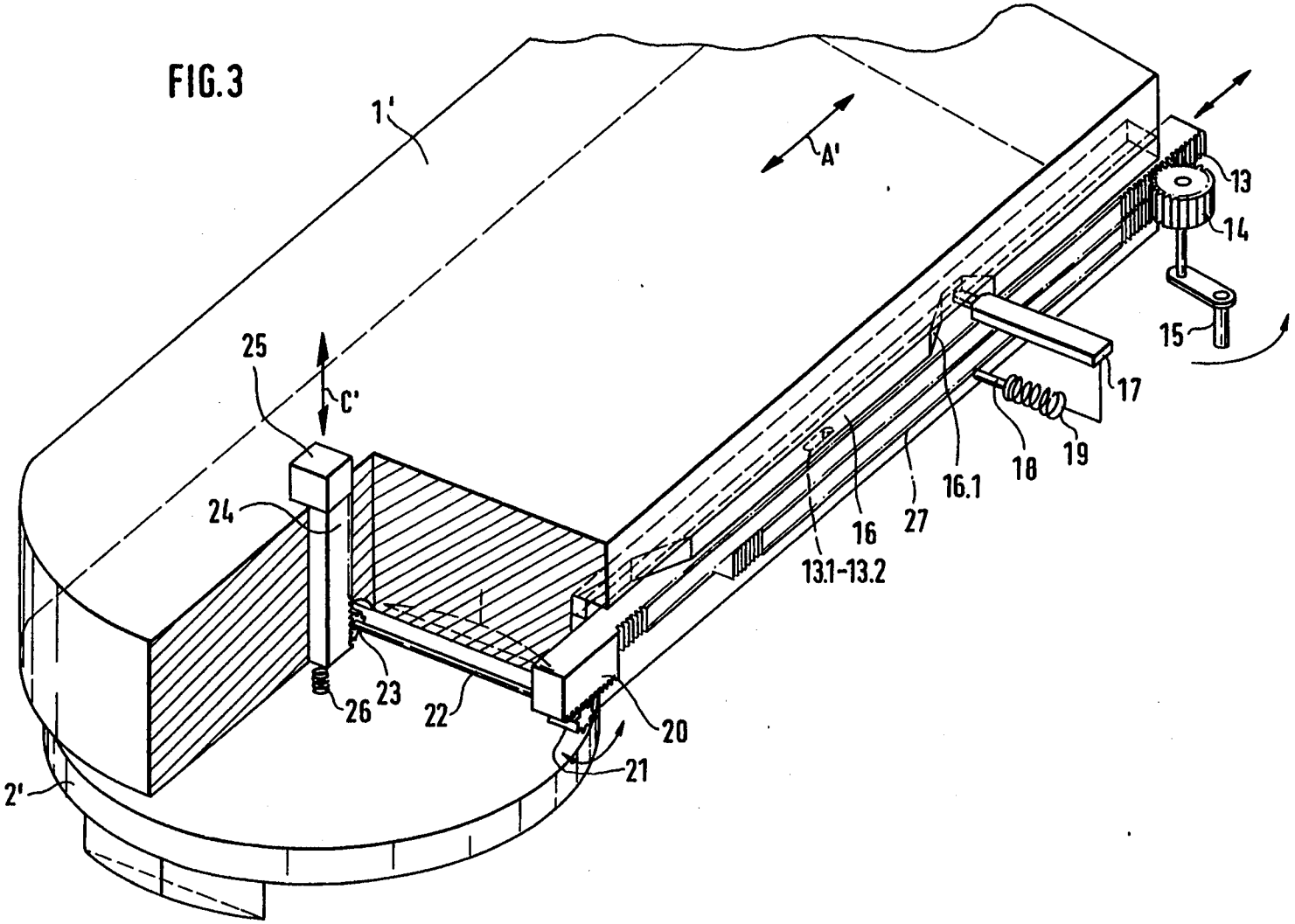
FIG. 3 is a view similar to that in FIG. 2 of another embodiment of the device, which both slides the upper component back and forth and lifts and lowers the lower component.

The hatch illustrated in FIG. 3 comprises an upper component 1' and a lower component 2'. Upper hatch component 1' slides back and forth above the hatchway in the direction indicated by double-headed arrow A' and lower hatch component 2' descends into and rises out of the hatchway in the direction indicated by double-headed arrow C'.

Both hatch components are controlled by way of a crank 15 inside the tank. The crank rotates a pinion 14. Pinion 14 engages an operations-control rack 13. Rack 13 travels back and forth in the same direction as upper hatch component 1' in an unillustrated track. The operations-control rack has cogs with ridges perpendicular to the plane of the hatchway. On the bottom of operations-control rack 13 is a cam track 16 that governs the motions of a locking mechanism. This mechanism includes a compression spring 19 that engages a bolt 18 with an unillustrated locking component on upper hatch component 1'. Bolt 18 is attached by a connector, which can be a U-shaped strap, 17.1 to a control pin 17 that rests against the outward edge of cam track 16. Rack 13 terminates in an extension 20 that projects out toward lower hatch component 2' and constitutes another operations-control rack. There are cogs on the bottom of extension 20. The ridges of the cogs parallel the plane of the hatchway. The extension 20 of operations-control rack 13 is engaged by a pinion 21. Pinion 21 is mounted tight on a shaft 22 that parallels the plane of the hatchway. Mounted tight on the other end of shaft 22 is another pinion 23. Pinion 23 engages an upright rack 24. Lower hatch component 2' is fastened tight to the bottom of upright rack 24. This rack travels up and down in channels 25 mounted on upper hatch component 1', lifting and lowering lower hatch component 2' in the direction indicated by double-headed arrow C'. A compression spring 26 ensures that lower hatch component 2' will fit tight in the hatchway.

A displacement rack 27 is fastened parallel to operations-control rack 13 on the upper hatch component 1' of the embodiment illustrated in FIG. 3. The cogs on displacement rack 27 parallel those on operations-control rack 13. Rack 27 is coupled to operations-control rack 13 by a pin 13.2 and slot 13.1. When crank 15 begins to turn, accordingly, operations-control rack 13 will initially travel some distance before engaging displacement rack 27 by way of pin 13.2 and slot 13.1 and in conjunction with operations-control rack 13 engaging upper hatch component 1'. Before upper hatch component 1' engages, however, control pin 17 will travel along a cam 16.1 of cam track 16 and disengage the bolt 18 that locks upper hatch component 1' into position with the hatchway closed. The extension 20 of operations-control rack 13 will move along with it, and pinions 21 and 23 will raise upright rack 24, lifting lower hatch component 2'. This motion will cease, however, before displacement rack 27 begins to move. The pinion 14 that moves operations-control rack 13 back and forth is wide enough and the position and width of displacement rack 27 adapted sufficiently to pinion 14 to ensure that pinion 14 will engage displacement rack 27 as soon as rack 27 is entrained by pin 13.2 and immediately begin to move upper hatch component 1'. This feature eliminates the need to transmit all the forces involved by way of pin 13.2.

A displacement rack 27 of this design ensures that the direct engagement between pinion 14 and rack 27 will be maintained once the hatch is open and as upper hatch component 1' begins to close it. Rack 13 will accordingly not initially be unengaged. Mechanisms 17 through 19 will also keep upper hatch component 1' locked in position while the hatchway is open. The locking mechanisms must accordingly be manually disengaged by an unillustrated mechanism before the hatchway can be closed.

Figure 4:
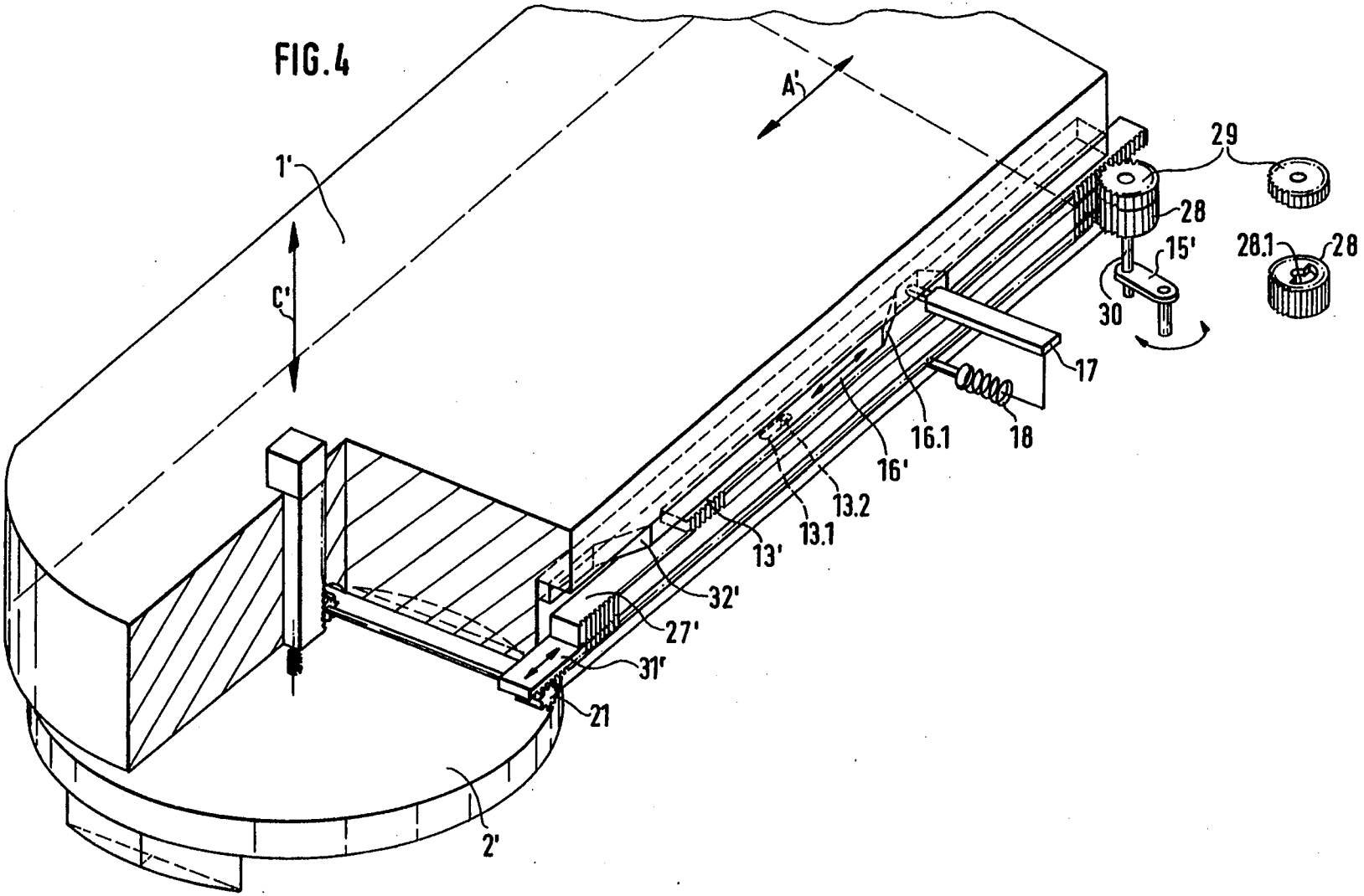
FIG. 4 is a perspective view of part of another version of the embodiment illustrated in FIG. 3.

Once the hatchway is closed, pinion 14 will leave displacement rack 27 with upper hatch component 1' resting against a stop. Slot 13.1 and pin 13.2 will now disengage operations-control rack 13. Control pin 17 will simultaneously leave cam 16.1, allowing compression spring 19 to lock bolt 18 with the hatchway closed. Pinions 21 and 23 will simultaneously lift lower hatch component 2' by way of racks 20 and 24. FIG. 4 illustrates another version of the embodiment illustrated in FIG. 3. This version makes it possible to also disengage the locking mechanism while the hatchway is open by way of the same crank that controls the other operations involved in opening and closing the hatchway.

FIG. 4 illustrates only the components involved in the additional operations. An operations-control rack 13' is attached to another displacement rack 27' on the upper hatch component by way of a slot 13.1' and pin 13.2. A cam track 16' rests against operations-control rack 13'. The cam track governs by way of a control pin 17 the bolt 18 that locks upper hatch component 1' with the hatchway either open or closed (by traveling over a slope 32').

Parallel and immediately adjacent to displacement rack 27' is still another operations-control rack 31'. Rack 31' travels back and forth along racks 13' and 27'. As will be evident from FIG. 4, there is a cogged section at the end of operations-control rack 31' facing lower hatch component 2' with the ridges of the cogs paralleling the plane of the hatchway. The pinion that lifts and lowers lower hatch component 2' engages that section as hereintofore specified with reference to FIG. 3. The remaining length of operations-control rack 31' is provided with cogs on the same side, in the same plane, and pointing in the same direction as the cogs on displacement rack 27'. As will also be evident from FIG. 4, operations-control rack 31' projects beyond displacement rack 27' at each end to a prescribed extent. Rack 13' is engaged by a pinion 29 that is attached directly to a crank 15' by a shaft 30. Rack 31' is engaged by a pinion 28 associated with a track and attached to the shaft 30 that crank 15' is mounted on by an entrainer 28.1. Pinion 28 simultaneously engages displacement rack 27' while the hatchway is being opened and closed.

How this hatchway opens and closes will now be specified. The crank is turned and pinion 29 engages operations-control rack 13', unlocking upper hatch component 1' while the hatchway is still closed. Pinion 28, which initially engages only operations-control rack 31' now lifts lower hatch component 2'. Once operations-control rack 13' has advanced far enough unengaged, displacement rack 27' is displaced along with upper hatch component 11', whereby pinion 28 will engage both displacement rack 27' and operations-control rack 31'. Upper hatch component 1 is locked in position again once the hatchway is open.

Crank 15' is turned again. Pinion 29 initially engages only operations-control rack 13', unlocking upper hatch component 1'. Pinion 28 travels along its track unengaged and is accordingly not initially entrained. Once it engages, pinion 28, in conjunction with displacement rack 27' and operations-control rack 31' closes the hatchway with upper hatch component 1' and locks the component into that position as hereintofore specified. Pinion 28 leaves displacement rack 27' and engages, as will be evident from FIG. 4, only operations-control rack 31', lowering lower hatch component 2 and locking it tightly into position.

What is claimed is:

1. A combat vehicle comprising: a hatchway; a hatch having upper and lower components; and means mounting the upper component for sliding movement back and forth along a given direction and above the hatchway and mounting the lower component for up and down movement to descend tight into the hatchway comprising an operations-control rack extending along the upper component in the given direction, means mounted on the vehicle and controllable from within the vehicle for opening and closing the hatch including a first rotatable pinion engaging the operations-control rack to move the rack in the given direction, a cam track fastened to the operations-control rack, a control pin resting against the cam track and coactive therewith, means connected to the control pin for locking the upper component in a closed position, a clutch connecting the upper component to the operations-control rack to advance the rack to a certain extent during a first stage of opening of the hatchway before it engages the upper component for movement with the rack, and wherein the control pin coacts with the cam track to disengage the means locking the upper component into the closed position during the first stage of opening while the hatchway is closed and the rack is still unengaged.

2. The vehicle as in claim 1, wherein the clutch comprises a clutch pin that travels along the given direction in a slot between the operations-control rack and the upper component of the hatch, wherein the slot is configured to permit the clutch pin to advance while the rack is still unengaged.

3. The vehicle as in claim 2, wherein the means for locking has means for locking the upper component into an open position with the hatchway open and wherein the cam track is configured to coact with the control pin to unlock the locking means while the operations-control rack is still unengaged during a first stage of closing the hatchway.

4. The vehicle as in claim 1, wherein the lower hatch component rests against the upper component and the upper component has means for lifting and lowering the lower component, wherein the lifting means includes a lifting operations-control rack, a second rotatable pinion engaging the lifting rack and a transmission attached to the second pinion to rotate the second pinion, wherein the lifting rack is designed and positioned to be moved by the second pinion while the operations-control rack is still advancing unengaged.

5. The vehicle as in claim 4, wherein the second operations-control rack has cogs at least partly therealong with ridges parallel to a plane of the hatchway, the second pinion is connected by a shaft to a third rotatable pinion and the third pinion engages an upright rack that travels up and down on a top portion of the lower hatch component in the upper hatch component.

6. The vehicle as in claims 5, wherein the lifting operations-control rack comprises an extension of the operations-control rack that projects out of an end of the first operations-control rack toward the lower hatch component.

7. The vehicle as in claim 5, further comprising a displacement rack fastened tight to the upper hatch component and parallel with and adjacent to the operations-control rack and with cogs on the same side, in the same plane, and pointing in the same direction as that of the operations-control rack, wherein the clutch has means fastening the displacement rack to the operations-control rack such that the first pinion directly engages the displacement rack once the operations-control rack has traveled a given distance unengaged.

8. The vehicle as in claim 7, wherein the lifting operations-control rack is parallel with and immediately adjacent to the displacement rack and is mounted to move back and forth along the operations-control rack and the displacement rack and has an extension with cogs projecting out of the end toward the lower hatch component, wherein ridges of cogs of the lifting operations-control rack are parallel to a plane of the hatchway and wherein cogs along a remainder of the lifting operations-control rack are on the same side and in the same plane and point in the same direction as the cogs on the displacement rack, wherein the lifting operations-control rack is longer than the displacement rack, and wherein the first pinion comprises two pinion members attached to a shaft with one pinion member attached to the shaft by an entrainer to ensure that the one pinion member will idle before the hatch begins to close the hatchway while the locking means is disengaged.

9. The vehicle as in claims 1, wherein the cam track has a cam surface perpendicular to a plane of the hatchway, and the control pin travels along the cam track parallel with the plane of the hatchway, and wherein the locking means includes a compression spring biasing the locking means into a locking position.

* * * * *